United States Patent [19]

Boerwinkle et al.

[11] 4,130,524

[45] Dec. 19, 1978

[54] CORROSION INHIBITING COMPOSITIONS

[75] Inventors: Fred P. Boerwinkle, St. Paul; Tadeusz Szauer, Anoka, both of Minn.

[73] Assignee: Northern Instruments Corporation, Lino Lakes, Minn.

[21] Appl. No.: 856,403

[22] Filed: Dec. 1, 1977

[51] Int. Cl.[2] ..... C23F 11/14; C23F 11/16

[52] U.S. Cl. ..... 260/29.6 HN; 106/14.12; 106/14.31; 106/14.18; 106/14.42; 148/6.15 R; 252/389 A; 252/392; 260/29.6 MP; 260/29.6 N; 427/156

[58] Field of Search ..... 252/389 A, 392, 8.55 E; 21/2.7 A, 2.5 A; 208/47; 148/6.15 R; 427/156; 106/14.12, 14.18, 14.31, 14.42; 260/29.6 HN, 29.6 N, 29.6 MP

[56] References Cited

U.S. PATENT DOCUMENTS

| | | | |
|---|---|---|---|
| 3,493,440 | 2/1970 | Ashdown | 106/14.12 |
| 3,583,932 | 6/1971 | Benton et al. | 427/156 |
| 3,787,319 | 1/1974 | Larson | 106/14.12 |
| 3,836,537 | 9/1974 | Boerwinkle et al. | 260/29.6 HN |
| 3,935,125 | 1/1976 | Jacob | 252/389 A |
| 4,066,398 | 1/1978 | Hwa | 252/389 A |

*Primary Examiner*—Benjamin R. Padgett
*Assistant Examiner*—Irwin Gluck

[57] ABSTRACT

Compositions are described which contain (a) salt of carboxylic acid and organic amine, (b) salt of phosphoric acid and organic amine or salt of alkyl acid phosphate and organic amine, and (c) water-dispersible polymer. The compositions are preferably water-based and provide particularly good corrosion resistance to metals.

23 Claims, No Drawings

CORROSION INHIBITING COMPOSITIONS

BACKGROUND OF THE INVENTION

This invention relates to corrosion inhibition. More particularly, this invention relates to novel compositions which are useful for coating surfaces to provide temporary protection against corrosion.

There are numerous instances in industry where an easily-corrodable material (e.g. iron, steel, or other metal) is subjected to a variety of corrosive environments between the time when it is manufactured and the time when it is actually used as a raw material in the manufacture of an intended product. For example, sheet steel or iron, after it leaves the smelter and before it is incorporated by the purchaser into an end product, undergoes a considerable period (e.g. 3–12 months) of shipment, storage and handling. During such shipment, storage and handling, the metal may be subjected to environments which are capable of quickly corroding the surface of such material (e.g. environments such as air, air containing high humidity, air containing corrosive salts such as sodium chloride found in marine or industrial environments, rain, surface condensation, etc.). With increasing lengths of time before use, or with increasing severity of the environment to which the material is subjected before use, the greater is the degree of corrosion.

Consequently, it is usually necessary to remove the undesirable corrosion which is present on the surface of the material before such material may be satisfactorily used by the purchaser.

Unfortunately, this may be a very expensive and time-consuming process. Even more unfortunately, when the metal material is intended to be used in the manufacture of such products as painted or electroplated articles, even minute amounts of corrosion of the metal render such metal completely unsatisfactory for its intended purpose. In such event the metal must typically be returned to the smelter and replaced with new material. Where metal articles are shipped overseas, they are exposed to warm temperature, high humidity and corrosive salts in the atmosphere, and corrosion is a particularly severe problem.

In attempts to reduce or eliminate corrosion of metal during shipment and storage, various types of coatings and temporary protectants have been proposed. For example, it is possible to simply coat the metal with an oil, grease or wax. However, such types of coatings are not always effective, and they may be quite undesirable due to their flammability or oily nature. Furthermore, such types of coatings normally must be completely removed from the metal surface before the metal may be used in many manufacturing processes. Such removal naturally is time consuming and also requires the use of solvents, with attendant expense and pollution problems. Although the addition of conventional corrosion inhibiting materials to such oils, greases and waxes may render such types of coatings more effective, the problems associated with removal of the coating, when necessary, are not alleviated. Oil-based corrosion inhibiting compositions are described, for example, in U.S. Pat. No. 2,736,658 and U.S. Pat. No. 3,234,270.

Others have proposed the use of water soluble corrosion inhibiting materials. For example, in U.S. Pat. No. 2,918,390 there is proposed the treatment of metal with water soluble fatty acid amines, followed by treatment with a solution containing hexavalent chromium. In U.S. Pat. No. 3,017,353 there is described a composition which may be added to an aqueous phase or an oil phase. In U.S. Pat. No. 3,977,994 there is described an emulsion containing a mixture of certain amines and organic acids. In U.S. Pat. No. 3,625,859 there are described specific corrosion inhibiting salts which are said to be soluble in either a water-based system or an oil-based system. In U.S. Pat. No. 3,573,225 there is described an aqueous solution containing specified amounts of specific salts. In U.S. Pat. No. 3,553,150 there is described oil-based coating compositions containing amine alkyl acid phosphate salts and optionally containing carboxylic acids. In U.S. Pat. No. 3,846,071 there is described corrosion inhibiting compositions for use in oil wells containing an acidic phosphate ester of an oxyalkylated alcohol and cyclic amidines. None of such patents, however, describe the novel compositions of the present invention.

SUMMARY OF THE PRESENT INVENTION

In accordance with the present invention there is provided a corrosion inhibiting composition comprising:

(a) an effective amount of a salt of a carboxylic acid and an organic amine, wherein said acid has 8 to 20 carbon atoms, and wherein said amine is selected from compounds of the formula (i)

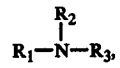

where $R_1$ is alkyl or alkenyl of 11 to 20 carbons, $R_2$ and $R_3$ are —H, —$CH_3$ or —$CH_2CH_2OH$; and (ii)

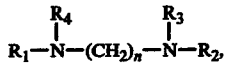

where n is an integer of 2–4, $R_4$ is —H, —$CH_3$ or —$CH_2CH_2OH$; and (b) an effective amount of a salt selected from:

(i) salt of phosphoric acid and a second organic amine of the formula

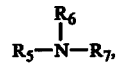

where $R_5$, $R_6$ and $R_7$ are selected from —H, alkyl and cycloalkyl, hydroxy-substituted alkyl and cycloalkyl, alkenyl and cycloalkenyl, and hydroxy-substituted alkenyl and cycloalkenyl, wherein the sum of the carbon atoms in $R_5$, $R_6$ and $R_7$ is in the range of 6 to 12; and (ii) salt of said second organic amine and an alkyl acid phosphate, wherein said alkyl group has from 1 to 8 carbons; and (c) a water-dispersible polymer derived from the free-radical-initiated addition polymerization of the following monomers in the mol percentage given:

(i) an amine monomer of the formula $$CH_2{=}C(R_{10})-C(=O)-X-R_{11}-N(R_{13})-R_{12},$$

where $R_{10}$ is —H, —$CH_3$ or —$CH_2CH_3$, $R_{11}$ is —$CH_2CH_2$— or —$CH_2CH_2CH_2$—, $R_{12}$ and $R_{13}$ are H or alkyl of 1-4 carbons; X is —O—, —NH— or —S—; present in an amount of about 40 to 100 mol percent;

(ii) an acidic monomer of the formula $$CH_2-C(R_{10})-C(=O)OH;$$

present in an amount ranging from 0 to 50 mol percent; and (iii)

$$CH_2{=}C(R_{10})-C(=O)-X-R_{14},$$

where $R_{14}$ is hydrogen or alkyl of 1 to 4 carbons; present in an amount ranging from 0 to 20 mol percent;

wherein the total mol percent of acidic monomer in said polymer is not greater than the mol percent of said amine monomer.

The compositions of the invention are water-dispersible and accordingly are preferably applied to substrates from an aqueous medium. Various additives may be included to alter the physical properties of the composition or of coatings obtained therewith. The novel compositions are biodegradable, have low toxicity, and are accordingly environmentally benign. Such compositions impart excellent temporary corrosion resistance to substrates such as metals.

DETAILED DESCRIPTION OF THE INVENTION

The corrosion inhibiting compositions of the invention contain (a) a first salt of carboxylic acid and organic amine, (b) a second salt of organic amine and phosphoric acid or alkyl acid phosphate, and (c) water-dispersible polymer. Preferably, the composition is applied to the desired substrate from an aqueous medium.

The carboxylic acids which are useful in the preparation of the first salt referred to above include mono- and di-carboxylic acids having 8 to 20 carbon atoms. These compounds may be saturated, although preferably they contain one or more sites of ethylenic unsaturation. The compounds may be cyclic or acyclic. Representative examples of carboxylic acids suitable for use in making the salts employed in this invention include oleic, linoleic, linolenic, stearic, margaric, palmitic, palmitoleic, myristic, lauric, undecylenic, hexyl benzoic, octyl benzoic, dodecyl succinic, decenyl succinic, commercially available mixtures such as soy bean and tallow oil derived fatty acids, etc.

The organic amines which are useful in the preparation of the first salt employed in this invention are selected from (a) fatty amines of the formula $$R_1-N(R_2)-R_3,$$

where $R_1$ is alkyl or alkenyl of 11 to 20 carbons, and $R_2$ and $R_3$ are —H, —$CH_3$, or —$CH_2CH_2OH$, and (b) diamines of the formula $$R_1-N(R_4)-(CH_2)_n-N(R_2)-R_3,$$

where $n$ is an integer of 2 to 4 (preferably 3), $R_4$ is —H, —$CH_3$ or —$CH_2CH_2OH$.

Representative examples of fatty amines suitable for use in making the salts employed in this invention include oleyl, linoeyl, linolenyl, stearyl, margaryl, palmityl, myristyl, lauryl, undecylenyl, commercially available mixtures such as the amine fractions derived from, for example, tallow and soy bean fatty acid fractions, the corresponding methyl, dimethyl, hydroxyethyl and dihydroxy-ethyl derivatives and other amines of the formula which are well known to those skilled in the art.

Representative examples of diamines suitable for use in making the salts employed in this invention include N-substituted propylene diamines such as oleyl, linoleyl, linolenyl, stearyl, margaryl, palmityl, myristyl, lauryl, undecylenyl, commercially available mixtures such as the amine fractions derived from, for example, tallow and soy bean oil fatty acid fractions, the corresponding methyl, dimethyl, hydroxyethyl and dihydroxy-ethyl derivatives and other diamines of the formula which are well known to those skilled in the art.

The second salt employed in the compositions of this invention is selected from:

(a) salt of phosphoric acid and a second organic amine of the formula $$R_5-N(R_6)-R_7,$$

where $R_5$, $R_6$ and $R_7$ are selected from hydrogen, alkyl and cycloalkyl, hydroxy-substituted alkyl and cycloalkyl, alkenyl and cycloalkenyl, and hydroxy-substituted alkenyl and cycloalkenyl, wherein the sum of the carbon atoms in $R_5$, $R_6$ and $R_7$ is in the range of 6–12. Representative examples of this type of salt include cyclohexylammonium phosphate and dicyclohexylammonium phosphate.

(b) salt of said second organic amine and an alkyl acid phosphate, wherein said alkyl group has from 1 to 8 carbons. Representative examples of this type of salt include cyclohexylamine butyl acid phosphate salt, dicyclohexylamine butyl acid phosphate salt, methylcyclohexylamine butyl acid phosphate salt, cyclohexylamine octyl acid phosphate salt, triethylamine butyl acid phosphate salt, and triethanolamine octyl acid phosphate salt.

These organic amine phosphate salts, or alkyl acid phosphate salts, may be prepared simply by admixing appropriate amounts of said amine and said acid in a suitable solvent, such as is well known to those skilled in the art.

The polymers which are useful in the compositions of this invention are ionic and water-dispersible. The term "water-dispersible" means that the polymer is either soluble or otherwise stably dispersible in water at the desired concentration. These polymers are derived from the free-radical-initiated addition polymerization of the following monomers in the mol percentages given:

(i) an amine monomer of the formula

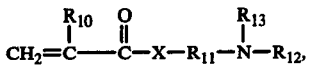

where $R_{10}$ is —H, —$CH_3$ or —$CH_2CH_3$, $R_{11}$ is —$CH_2CH_2$— or —$CH_2CH_2CH_2$—, $R_{12}$ and $R_{13}$ are H or alkyl of 1–4 carbons, X is —O—, —NH— or —S—; present in an amount of about 40 to 100 mol percent.

(ii) optionally, an acidic monomer of the formula

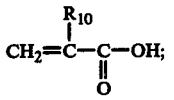

present in an amount ranging from 0 to about 50 mol percent.

(iii) optionally, a third monomer of the formula

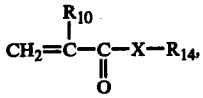

where $R_{14}$ is hydrogen or alkyl of 1 to 4 carbons; present in an amount ranging from 0 to about 20 mol percent; wherein the total mol percent of acidic monomer in said polymer is not greater than the mol percent of said amine monomer.

The polymers are prepared using conventional aqueous solution polymerization technique such as described in U.S. Pat. No. 3,836,537, incorporated herein by reference. For purposes of the present invention, it is preferred to polymerize the monomers to the extent that an aqueous solution of the desired polymer, at 24% by weight solids, exhibits a viscosity at room temperature, when measured on a Brookfield viscometer, in the range of about 1000 to 100,000 centipoise when measured with the appropriate spindle at the appropriate speed.

The optionally included acidic monomer, which may constitute up to 50 mol percent of the polymer (but not more than the mol percentage of amine monomer), may be included, for example, to enhance water-dispersibility of the polymer. Representative examples of such acidic monomers are acrylic and methacrylic acid. The optionally included third monomer, which may constitute up to about 20 mol percent of the polymer, may be included in order to adjust the stability or coating characteristics of the composition. Representative examples of such monomers are alkyl ($C_1$–$C_4$) acrylic and methacrylic esters and amides such as ethyl acrylate, butyl acrylate, and N,N-dimethyl acrylamide. Acrylamide and methacrylamide may also be used as this third monomer.

When the polymer is a homopolymer derived from the above-described amine monomer, it is necessary, when such homopolymer is used in aqueous coating compositions of this invention, to neutralize the basic groups on such polymer such that the pH of the final composition is brought into the range of about 6 to 10. It is preferred to neutralize such basic groups on the polymer, as described above, with a carboxylic acid having 6 to 10 carbon atoms; however, the basic groups may also be neutralized with carboxylic acids of the type used to prepare the $C_8$–$C_{20}$ acid-amine salt described above.

The corrosion inhibiting compositions of the invention are prepared by admixing the first and second salts described above with the water-dispersible polymer described above. Generally speaking, the weight ratio of the polymer to the total amount of salts is in the range of about 1:0.25 to 0.25:1, and preferably in the range of about 1:1 to 1:0.5. The weight ratio of first salt to second salt is normally in the range of 1:1 to 1:10, preferably 1:5.

Preferably, the compositions of the invention are aqueous-based. Such compositions are preferably prepared by preparing a suitable concentration (e.g. 1–10% by weight) of polymer in water, followed by addition of the first salt (e.g. in an amount of about 0.5–5% by weight), followed by addition of the second salt in an amount of about 1–10% by weight. Optionally, the appropriate carboxylic acid and appropriate fatty amine may be added separately, in appropriate amounts, to a water solution of water-dispersible polymer at the desired concentration in order to form the first salt in situ. The aqueous-based compositions are typically subjected to a high-shear mixing in order to effectively disperse the salts therein. Although some phase separation may tend to occur upon standing, the composition may be rendered effectively homogeneous again with simple stirring.

In order to improve or enhance the corrosion inhibiting effectiveness of the compositions of this invention, one may add a mercaptan, having 12 to 20 carbon atoms, in amounts up to about 5% by weight in aqueous-based compositions. Representative examples are dodecyl and octadecyl mercaptans. Similarly, one may add guanidine or an alkyl substituted guanidine, wherein the alkyl group has from 1 to 6 carbon atoms, in amounts up to about 5% by weight in aqueous-based compositions. Representative examples are guanidine and 1,1,3,3-tetramethylguanidine.

Another optional additive known to the art, which may be included in aqueous compositions in amounts up to about 2% by weight, is an amide of the formula

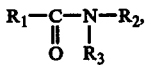

where $R_1$, $R_2$ and $R_3$ are as defined above. Such additive may be included in order to enhance the stability of aqueous-based compositions.

When it is desirable to have an aqueous-based coating composition which when applied to a substrate leaves a lubricious coating (i.e. oily, greasy or waxy), hydrocarbons such as paraffinic materials (e.g. mineral oil, petrolatum, or paraffin wax) may be included in the compositions in amounts up to about 10 percent by weight (but preferably not in an amount greater than the percent solids of such composition). These hydrocarbons are easily dispersed in aqueous compositions of this invention and in some cases actually improve the homogeneity of such compositions.

Still other additives which may be included in the compositions of the invention include low molecular weight alcohols (e.g. $C_1$–$C_6$ alcohols) in amounts up to about 20% by weight; microbiological preservatives (e.g. formaldehyde, formaldehyde derivatives, lower alkyl p-hydroxy benzoates); dyes, perfumes, and the like.

Preferably, the corrosion-inhibiting compositions of the invention are applied to the desired substrate from an aqueous medium. Typically, standard coating techniques such as spraying, dipping or brushing may be used, although any manner of application of the composition is suitable so long as a substantially continuous coating on the substrate is obtained. The compositions of this invention have been found to provide particularly effective corrosion inhibition or resistance on metallic substrates including ferrous substrates (e.g. iron, steel), and non-ferrous substrates, such as copper and brass.

The invention is further illustrated by means of the following examples, wherein the term "parts" refers to parts by weight unless otherwise indicated.

EXAMPLE 1

A corrosion inhibiting composition is prepared by first preparing a water-dispersible ionic polymer, followed by adding to a water solution of such polymer appropriate amounts of carboxylic acid and amine such that the desired salt is formed in situ.

The water-dispersible polymer is prepared by the free-radical-initiated addition polymerization of the following monomers in the mol percentage stated:

| | Mol % |
|---|---|
| dimethylaminoethylmethacrylate | 50 |
| methacrylic acid | 50 |

These monomers are dissolved in water in a suitable reaction vessel in an amount such that the total weight percentage of monomer in water is 24%. This solution is heated to approximately 70° C. with stirring, after which 0.5% (based on the weight of monomer) of ammonium persulfate catalyst is added. The reaction mixture exotherms to about 90° C. in about 15 minutes, and the reaction mixture is maintained at 90° C. for another 15 minutes, after which the polymer solution is cooled to room temperature. The polymer solution (23.5–24% solids) has a Brookfield viscosity in the range of 5000 to 10,000 cps. at room temperature, and a pH of 6.2.

A 12.5 milliliter sample of the above polymer solution is diluted with 87.5 milliliters of water to provide a water solution having 3% by weight polymer present therein. To this resulting polymer solution is added 6 grams of cyclohexylamine butyl acid phosphate salt. Then 0.75 gram oleyl amine is added, with stirring, after which 0.75 gram oleic acid is added, with stirring. To improve the dispersion of the acid-amine salt in the polymer solution, the mixture is subjected to mixing, for 3 to 5 minutes, by a Kraft Apparatus. Inc. Non-Aerating Stirrer (Model S-30). A slightly milky dispersion is obtained having a pH of about 6.4.

The product composition is applied to clean mild steel (number 1010) test panels (4 inches × 6 inches) by spraying so as to obtain a continuous coating on such panels. The thus coated panels are immediately suspended vertically, and allowed to dry at room temperature for at least 4 hours.

The coated test panels, and clean un-treated control panels, are then subjected to condensing humidity at 100° F. according to the procedure of ASTM D-1735–62. The degree of corrosion is reported according to the Standard Method of Evaluating Degree of Rusting on Painted Steel Surfaces, ASTM D-610.68.

The untreated control test panels exhibited Grade 8 corrosion (0.1% of surface corroded) after 3 hours, and Grade 1 corrosion (greater than 50% of surface corroded) after 24 hours.

The test panels coated with the corrosion inhibiting composition of this Example, exhibited no corrosion at all (Grade 10) even after 1 week.

Additional test panels of clean mild steel (number 1010), 2 inches by 4 inches, are also coated with the composition of this Example by spraying and are hung vertically for 4 hours at room temperature. The coated test panels, and clean un-treated control panels, are then partically immersed in 100 ml. of 3.5% sodium chloride aqueous solution in a 250 ml. beaker at room temperature. Visible corrosion of the un-treated control panels is observed within 15 minutes, whereas no visible corrosion of the coated test panels is observed even after 10 hours. This demonstrates that the compositions of this invention are extremely effective in imparting resistance to chloride corrosion of mild steel under atmospheric conditions.

EXAMPLES 2–16

A variety of aqueous based corrosion inhibiting compositions are prepared and tested according to the procedures of Example 1. The formulations of the compositions are described in the following Table I.

The polymers used in such compositions are identified as follows:

| Type | Monomers (mol %) |
|---|---|
| A | polymer of Example 1 |
| B | dimethylaminoethylmethacrylate (50%)<br>acrylic acid (50%) |

The phosphate salts used in such compositions are identified as follows:

| Type | Name |
|---|---|
| A | cyclohexylammonium phosphate |
| B | dicyclohexylammonium phosphate |
| C | cyclohexylamine butyl acid phosphate salt |

The commercial ingredients listed in Table I are identified as follows:

"Ethomeen S-12" is diethoxylated soy amine; commercially available from Armak.

"Methocel E-15" is a modified water-soluble cellulose derivative; commercially available from Dow Chemical Co.

"Hyd Acid 0856" is a mixture of saturated fatty carboxylic acids having 8 and 10 carbons; commercially available from Ashland Chemical Co.

"Hyd Acid 1895" is a saturated fatty carboxylic acid having 18 carbons; commercially available from Ashland Chemical Co.

"Diam G-21" is N-coco 1,3 propylenediamine; commercially available from General Mills, Inc.

The TMG referred to in the table is 1,1,3,3-tetramethylguanidine. The DDT referred to is dodecanethiol.

TABLE I

| Ex. No. | Polymer Type | Polymer Weight % | Phosphate Salt Type | Phosphate Salt Weight % | Acid Type | Acid Weight % | Amine Type | Amine Weight % | Additive Type | Additive Weight % | Salt Water Immersion (Hours to Visible Corrosion |
|---|---|---|---|---|---|---|---|---|---|---|---|
| 2 | B | 3 | A | 7 | oleic | 0.6 | oleyl | 0.6 | TMG | 4 | 35 |
| 3 | B | 6 | A | 5 | oleic | 1.5 | triethanol | 1.5 | — | — | 7 |
| | A | 3 | A | 7 | Hyd Acid 1895 | 0.62 | Ethomeen/S-12 | 1.25 | — | — | 12 |
| 4 | | | | | Hyd Acid 0856 | 0.62 | | | | | |
| 5 | A | 4 | A | 8 | oleic | 1.5 | Diam G-21 | 1.5 | — | — | 10 |
| | | | | | | | | | TMG | 2 | |
| 6 | A | 3 | C | 6 | oleic | 1.5 | oleyl | 1.5 | DDT | 2 | |
| | | | | | | | | | Methocel E-15 | 0.2 | 70 |
| | | | | | | | | | TMG | 2 | |
| 7 | A | 3 | A | 7 | oleic | 1.0 | Diam G-21 | 1.0 | DDT | 4 | |
| | | | | | | | | | Ammonium oleate | 0.5 | 200 |
| 8 | B | 4 | B | 8 | oleic | 1.5 | Diam G-21 | 1.5 | TMG | 1.5 | 25 |
| | | | | | | | | | DDT | 3 | |
| 9 | B | 6 | A | 9 | Hyd Acid 0856 | 1.25 | Ethomeen/S-12 | 1.25 | TMG | 3 | 30 |
| | | | | | | | | | DDT | 4 | |
| 10 | A | 4 | A | 10 | oleic | 1.0 | Diam-G-21 | 1.0 | — | — | 15 |
| 11 | B | 4 | A | 8 | oleic | 1.5 | Diam G-21 | 1.5 | Ammonium oleate | 1 | 25 |
| | | | | | | | | | TMG | 2 | |
| 12 | B | 8 | A | 9 | oleic | 1.25 | Diam G-21 | 1.25 | DDT | 4 | 120 |
| | | | | | | | | | Ammonium oleate | 1 | |
| | | | | | | | | | TMG | 2 | |
| 13 | A | 3 | A | 8 | oleic | 1.5 | oleyl | 1.5 | DDT | 4 | 90 |
| | | | | | | | | | Ammonium oleate | 0.5 | |
| | | | | | | | | | TMG | 2 | |
| 14 | A | 3 | A | 7 | oleic | 1.25 | triethanol | 1.25 | DDT | 3 | 15 |
| | | | | | | | | | Ammonium oleate | 1 | |
| 15 | B | 3 | A | 7 | Hyd Acid 0856 | 1.25 | oleyl | 1.25 | TMG | 4 | 14 |
| 16 | A | 3 | C | 6 | oleic | 1.25 | oleyl | 1.25 | DDT | 2 | 50 |
| | | | | | | | | | Ammonium oleate | 1 | |

What is claimed is:

1. A corrosion inhibiting composition comprising:

(a) a salt of a carboxylic acid and a first organic amine, wherein said acid has 8 to 20 carbon atoms, and wherein said amine is selected from the group consisting of:

(i)

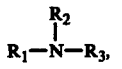

where $R_1$ is alkyl or alkenyl of 11 to 20 carbons, $R_2$ and $R_3$ are —H, —$CH_3$ or —$CH_2CH_2OH$; and (ii)

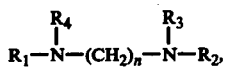

where $n$ is an integer of 2-4, $R_4$ is —H, —$CH_3$ or —$CH_2CH_2OH$; and (b) a salt selected from:

(i) salt of phosphoric acid and a second organic amine of the formula:

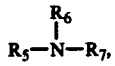

where $R_5$, $R_6$ and $R_7$ are selected from —H, alkyl and cycloalkyl, hydroxy-substituted alkyl and cycloalkyl, alkenyl and cycloalkenyl, and hydroxy-substituted alkenyl and cycloalkenyl, wherein the sum of the carbon atoms in $R_5$, $R_6$ and $R_7$ is in the range of 6 to 12; and (ii) salt of said second organic amine and an alkyl acid phosphate, wherein said alkyl group has from 1 to 8 carbons; and (c) a water-dispersible polymer derived from the free-radical-initiated addition polymerization of the following monomers in the mol percentages given:

(i) an amine monomer of the formula:

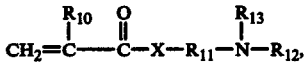

where $R_{10}$ is —H, —$CH_3$ or —$CH_2CH_3$, $R_{11}$ is —$CH_2CH_2$— or —$CH_2CH_2CH_2$—, $R_{12}$ and $R_{13}$ are H or alkyl of 1-4 carbons, X is —O—, —NH— or —S—; present in an amount of about 40 to 100 mol percent; and (ii) an acidic monomer of the formula:

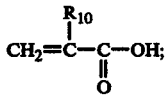

present in an amount ranging from 0 to about 50 mol percent; and (iii)

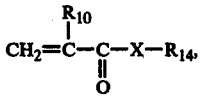

where $R_{14}$ is hydrogen or alkyl of 1 to 4 carbons; present in an amount ranging from 0 to about 20 mol percent;

wherein the total mol percent of acidic monomer in said polymer is not greater than the mol percent of said amine monomer.

2. An aqueous coating composition comprising:

(a) about 1 to 20 percent by weight of the composition of claim 1, and (b) about 80 to 99 percent by weight water.

3. A composition in accordance with claim 1, wherein the weight ratio of said polymer to the total weight of said salts is in the range of 1:0.25 to 0.25:1.

4. A composition in accordance with claim 1, wherein said carboxylic acid has at least one site of ethylenic unsaturation and wherein said first amine has at least one site of ethylenic unsaturation.

5. A composition in accordance with claim 1, wherein said polymer is derived from the copolymerization of (a) amine monomers selected from dimethylaminoethylmethacrylate, diethylaminoethylmethacrylate, and tertiary-butylaminoethylmethacrylate, and (b) acidic monomers selected from acrylic and methacrylic acid.

6. A composition in accordance with claim 1, wherein said polymer is derived from (a) amine monomers selected from dimethylaminoethylmethacrylate, diethylaminoethylmethacrylate and tertiary-butylaminoethylmethacrylate, and (b) acidic monomers selected from acrylic and methacrylic acid and (c) monomer selected from ethylacrylate and butylacrylate.

7. A composition in accordance with claim 1, further comprising an amide of the formula

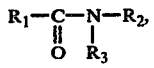

wherein $R_1$, $R_2$ and $R_3$ are as defined above.

8. A method of inhibiting corrosion on a substrate comprising applying the composition of claim 1 to said substrate.

9. An aqueous coating composition comprising, in an aqueous medium:

(a) an effective amount of a first salt of a carboxylic acid and a first organic amine, wherein said acid has 8 to 20 carbon atoms and wherein said amine is selected from the group consisting of:

(i)

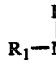

where $R_1$ is alkyl or alkenyl of 11 to 20 carbons, $R_2$ and $R_3$ are —H, —$CH_3$ or —$CH_2CH_2OH$; and (ii)

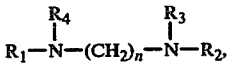

where n is an integer of 2–4, $R_4$ is —H, —$CH_3$ or —$CH_2CH_2OH$; and (b) a second salt selected from:

(i) salt of phosphoric acid and a second organic amine of the formula:

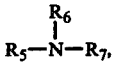

where $R_5$, $R_6$ and $R_7$ are selected from —H, alkyl and cycloalkyl, hydroxy-substituted alkyl and cycloalkyl, alkenyl and cycloalkenyl, and hydroxy-substituted alkenyl and cycloalkenyl, wherein the sum of the carbon atoms in $R_5$, $R_6$ and $R_7$ is in the range of 6 to 12; and (ii) salt of said second organic amine and an alkyl acid phosphate, wherein said alkyl group has from 1 to 8 carbons; and (c) a water dispersible polymer derived from the free-radical-initiated addition polymerization of the following monomers in the mol percentages given:

(i) an amine monomer of the formula:

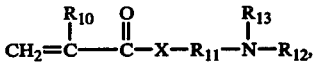

where $R_{10}$ is —H, —$CH_3$ or —$CH_2CH_3$, $R_{11}$ is —$CH_2CH_2$— or —$CH_2CH_2CH_2$—, $R_{12}$ and $R_{13}$ are H or alkyl of 1–4 carbons, X is —O—, —NH— or —S—; present in an amount of about 40 to 100 mol percent;

(ii) an acidic monomer of the formula:

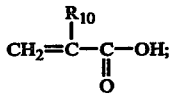

present in an amount ranging from 0 to about 50 mol percent; and (iii)

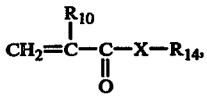

wherein $R_{14}$ is hydrogen or alkyl of 1 to 4 carbons; present in an amount ranging from 0 to about 20 mol percent;

wherein the total mol percent of acidic monomer in said polymer is not greater than the mol percent of said amine monomer.

10. A composition in accordance with claim 9, wherein said first salt is present in an amount of about 0.5 to about 5 percent by weight, said second salt is present in an amount of about 1 to about 10 percent by weight, and said polymer is present in an amount of about 1 to about 10 percent by weight.

11. A composition in accordance with claim 9, wherein said carboxylic acid has at least one site of ethylenic unsaturation and wherein said first amine has at least one site of ethylenic unsaturation.

12. A composition in accordance with claim 9, wherein said polymer comprises a homopolymer of said amine monomer.

13. A composition in accordance with claim 9, wherein said polymer is derived from the copolymerization of (a) amine monomers selected from dimethylaminoethylmethacrylate, diethylaminoethylmethacrylate, and tertiary-butylaminoethylmethacrylate, and (b) acidic monomers selected from acrylic and methacrylic acid.

14. A composition in accordance with claim 9, wherein said polymer is derived from the copolymerization of (a) amine monomers selected from dimethylaminoethylmethacrylate, diethylaminoethylmethacrylate and tertiary-butylaminoethylmethacrylate; and (b) acidic monomers selected from acrylic and methacrylic acid; and (c) monomer selected from ethylacrylate and butylacrylate.

15. A composition in accordance with claim 9, further comprising an amide of the formula

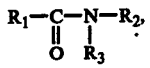

where $R_1$, $R_2$ and $R_3$ are as defined above.

16. A composition in accordance with claim 9, further comprising a hydrocarbon in an amount up to about 10 percent by weight.

17. A composition in accordance with claim 16, wherein said hydrocarbon is selected from mineral oil, mineral spirits and petrolatum.

18. A composition in accordance with claim 9, having a pH in the range of about 6 to 10.

19. A method for inhibiting corrosion on a substrate comprising applying the composition of claim 9 to said substrate.

20. A composition in accordance with claim 1, further comprising a mercaptan having 12 to 20 carbons.

21. A composition in accordance with claim 1, further comprising guanidine or alkyl-substituted guanidine, wherein said alkyl has 1 to 6 carbons.

22. A composition in accordance with claim 9, further comprising a mercaptan having 12 to 20 carbons.

23. A composition in accordance with claim 9, further comprising guanidine or alkyl-substituted guanidine, wherein said alkyl has 1 to 6 carbons.

* * * * *